US007022929B1

(12) United States Patent
Snider

(10) Patent No.: US 7,022,929 B1
(45) Date of Patent: Apr. 4, 2006

(54) DETECTABLE PUSH-PULL-THOUGH DETAILS FOR SWITCH PAD

(75) Inventor: Chris R. Snider, Kokomo, IN (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 11/185,070

(22) Filed: Jul. 20, 2005

(51) Int. Cl.
*H01H 13/702* (2006.01)
*H01R 33/96* (2006.01)

(52) U.S. Cl. ..... 200/512; 200/51.09; 341/22; 345/168

(58) Field of Classification Search ..... 200/5 A, 200/5 R, 512–517, 292, 51 R, 51.02, 51.09, 200/51.11, 51.12; 29/622; 341/22; 345/168.173, 345/178; 439/67.489
See application file for complete search history.

(56) References Cited

U.S. PATENT DOCUMENTS 4,491,702 A * 1/1985 Kato ..... 200/513
4,634,818 A * 1/1987 Hayes-Pankhurst et al. 200/513
5,952,629 A * 9/1999 Yoshinaga et al. ..... 200/512
6,486,427 B1 * 11/2002 Pruvot ..... 200/512
6,571,457 B1 * 6/2003 Naritomi ..... 200/5 A
6,677,843 B1 * 1/2004 Monroe et al. ..... 200/512
6,710,269 B1 * 3/2004 Kunigkeit et al. ..... 200/5 A
6,906,275 B1 * 6/2005 Koyama et al. ..... 200/516

* cited by examiner

*Primary Examiner*—Michael A. Friedhofer
(74) *Attorney, Agent, or Firm*—Stefan V. Chmielewski

(57) ABSTRACT

A control assembly comprising a switch pad and a circuit board. The switch pad has a connection member, a first contact adjacent the connection member, and a flexible dome having a second contact. The circuit board is engaged with the switch pad and includes an engagement area engaged with the connection member, third contacts adjacent the engagement area and fourth contacts. The flexible dome of the switch pad is configured to be depressed to engage the second contact with the fourth contacts to electrically connect the fourth contacts. The first contact electrically connects the third contacts when the circuit board is engaged with the switch pad. The first contact and the third contacts form a first circuit for determining if the switch pad is properly engaged with the circuit board such that the second contact will form a second circuit with the fourth contacts when the flexible dome is depressed.

20 Claims, 6 Drawing Sheets

DETECTABLE PUSH-PULL-THOUGH DETAILS FOR SWITCH PAD

TECHNICAL FIELD

The present invention concerns control assemblies, and more particularly relates to control assemblies having detectable push-pull-through details for a switch pad of the control assembly.

BACKGROUND OF THE INVENTION

Control assemblies are used extensively to selectively form a circuit for electronic assemblies. Examples of control assemblies are those used in electronic vehicle windows to selectively power the windows up or down, buttons to selectively turn on and off other controls of a vehicle and in any system wherein a switch is desired. The control of the control assemblies can be powered by manually depressing a switch pad of the control assemblies or by automatically depressing the switch pad.

Heretofore, control assemblies 100 (see FIG. 1) have included a switch pad 101 and a circuit board 102. The switch pad 101 includes a dome 104 having a conductive component 106 on a bottom surface thereof. When the dome 104 of the switch pad 101 is depressed, the conductive component 106 is engaged with a set of contacts 108 on the circuit board 102 to complete a circuit on the circuit board 102. However, some problems can occur when the switch pad 101 is not properly and fully seated on the circuit board 102. For example, as illustrated in FIG. 1, if the switch pad 101 is not properly and fully seated on the circuit board 102, the conductive component 106 may not engage all of the set of contacts 108 on the circuit board 102, thereby not forming a circuit with the set of contacts 108. Furthermore, when the switch pad 101 is not properly and fully seated on the circuit board 102, depression of the dome 104 can produce an undesirable tactile feel when the dome 104 is depressed.

Accordingly, an apparatus is desired having the aforementioned advantages and solving and/or making improvements on the aforementioned disadvantages.

SUMMARY OF THE INVENTION

An aspect of the present invention is to provide a control assembly comprising a switch pad and a circuit board. The switch pad has at least one connection member and at least one first contact adjacent at least one at least one connection member. The switch pad further includes a flexible dome having a second contact. The circuit board is engaged with the switch pad. The circuit board has at least one engagement area, with each engagement area engaged with at least one connection member. The circuit board further includes a set of third contacts adjacent at least one at least one engagement area and a set of fourth contacts. The flexible dome of the switch pad is configured to be depressed to engage the second contact with the set of fourth contacts to electrically connect the set of fourth contacts. The at least one first contact electrically connects the set of third contacts when the circuit board is properly engaged with the switch pad. The at least one first contact and the set of third contacts form a first circuit for determining if the switch pad is properly engaged with the circuit board such that the second contact will form a second circuit with the set of fourth contacts when the flexible dome is depressed.

Another aspect of the present invention is to provide a method of determining if a switch pad of a control assembly is properly aligned with a circuit board of a control assembly. The method comprises providing the switch pad with at least one connection member, at least one first contact adjacent at least one at least one connection member and a flexible dome having a second contact. The method also includes providing the circuit board with an engagement area, a set of third contacts adjacent the engagement area and a set of fourth contacts. The method further includes engaging the switch pad with the circuit board by engaging the at least one connection member with the engagement area of the circuit board. The method also includes electrically connecting the at least one first contact and the set of third contacts. Furthermore, the method includes sending a current through the set of third contacts to determine if the at least one first contact and the second of third contacts form a circuit.

Yet another aspect of the present invention is to provide a control assembly comprising a switch pad and a circuit board. The switch pad has a connection member and at least one first contact at least partially surrounding the connection member. The switch pad further includes a flexible dome having a second contact. The circuit board has an opening, with the connection member of the switch pad extending through the opening to connect the switch pad to the circuit board. The circuit board includes a set of third contacts adjacent the opening and a set of fourth contacts aligned with the second contact of the flexible dome of the switch pad. The flexible dome of the switch pad is configured to be depressed to engage the second contact with the set of fourth contacts to electrically connect the set of fourth contacts. The at least one first contact electrically connects the set of third contacts when the switch pad is connected to the circuit board. The at least one first contact and the set of third contacts form a first circuit for determining if the switch pad is properly connected to the circuit board such that the second contact will form a second circuit with the set of fourth contacts when the flexible dome is depressed.

These and other aspects, objects, and features of the present invention will be understood and appreciated by those skilled in the art upon studying the following specification, claims, and appended drawings.

BRIEF DESCRIPTION OF THE DRAWINGS

The present invention will now be described, by way of example, with reference to the accompanying drawings, in which.

DESCRIPTION OF THE PREFERRED EMBODIMENTS

Figure 1:
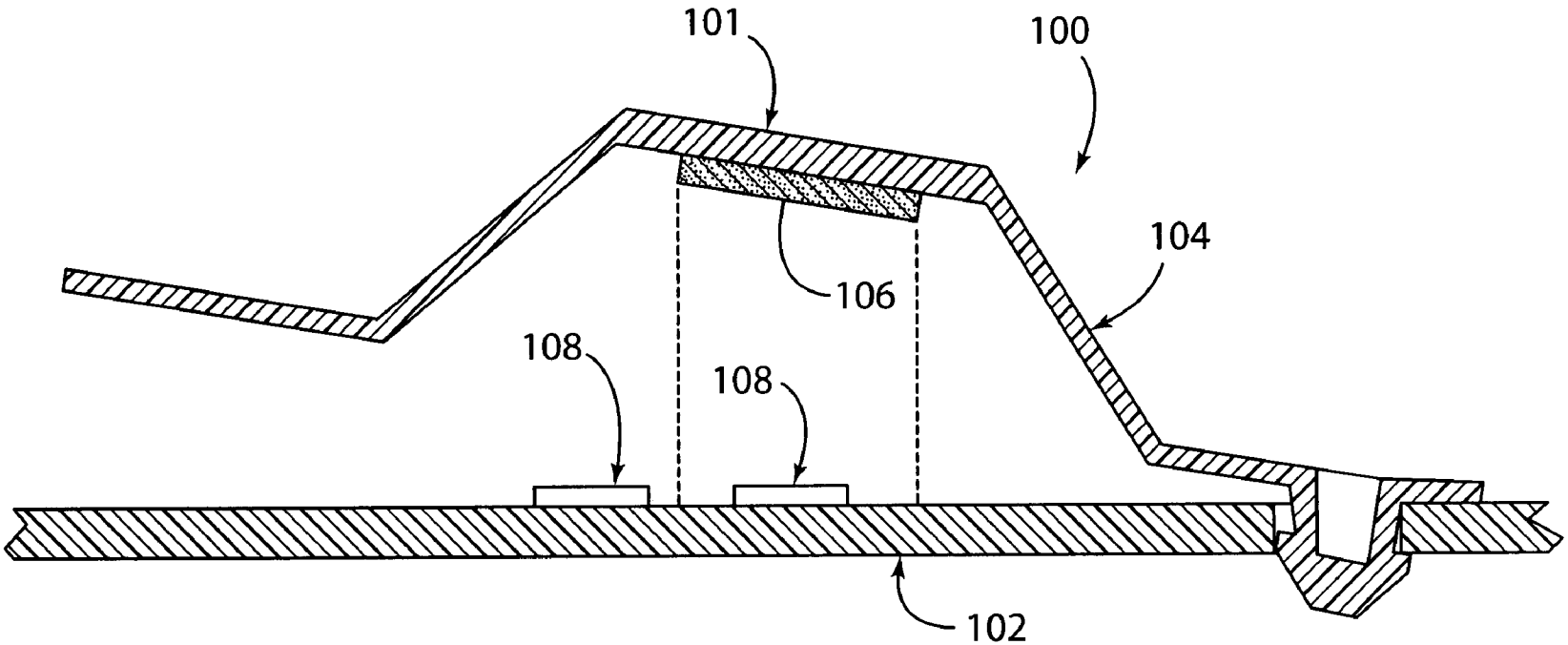
FIG.1 PRIOR ART
FIG. 1 is a cross-sectional view of a prior art control assembly.
Figure 2:
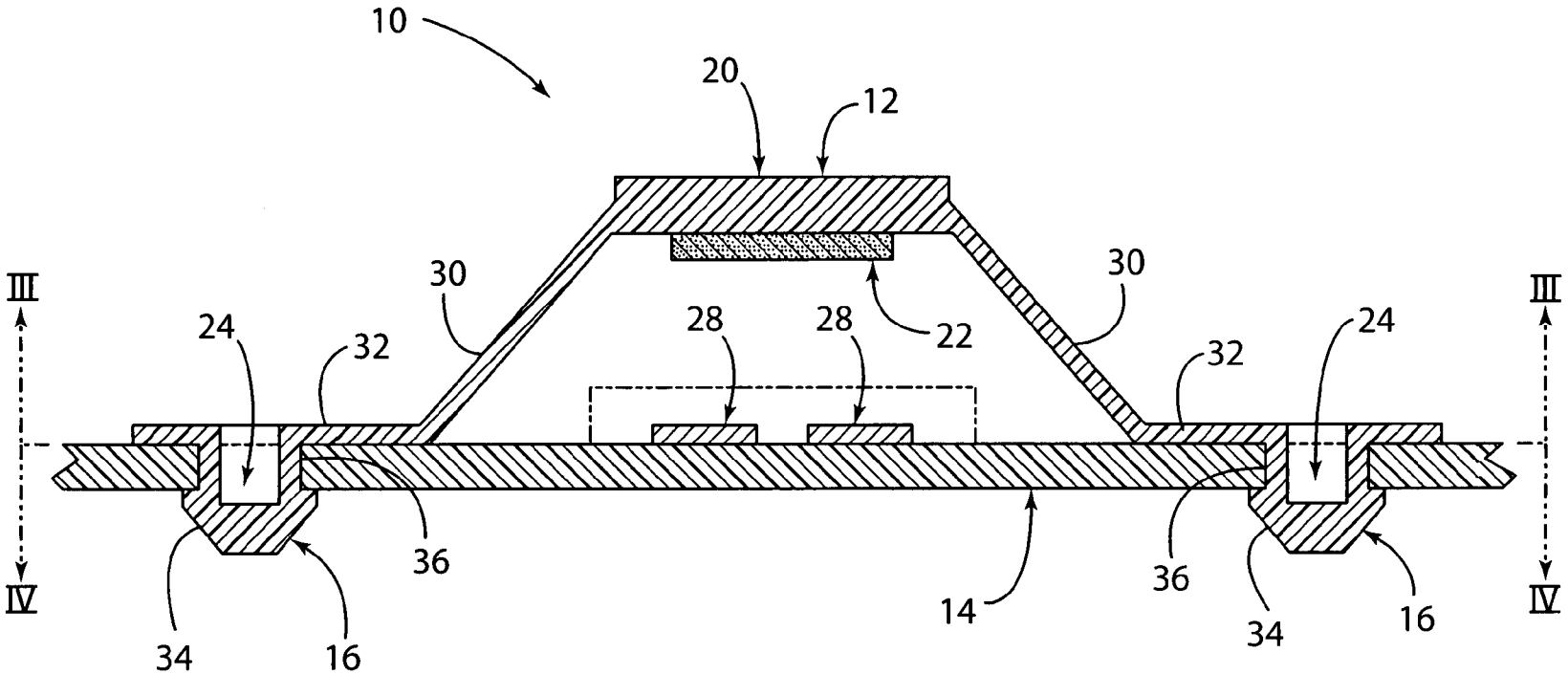
FIG. 2 is a cross-sectional schematic view of a control assembly of the present invention.

For purposes of description herein, orientation terms shall relate to the invention as orientated in FIG. 2. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

Figure 3:
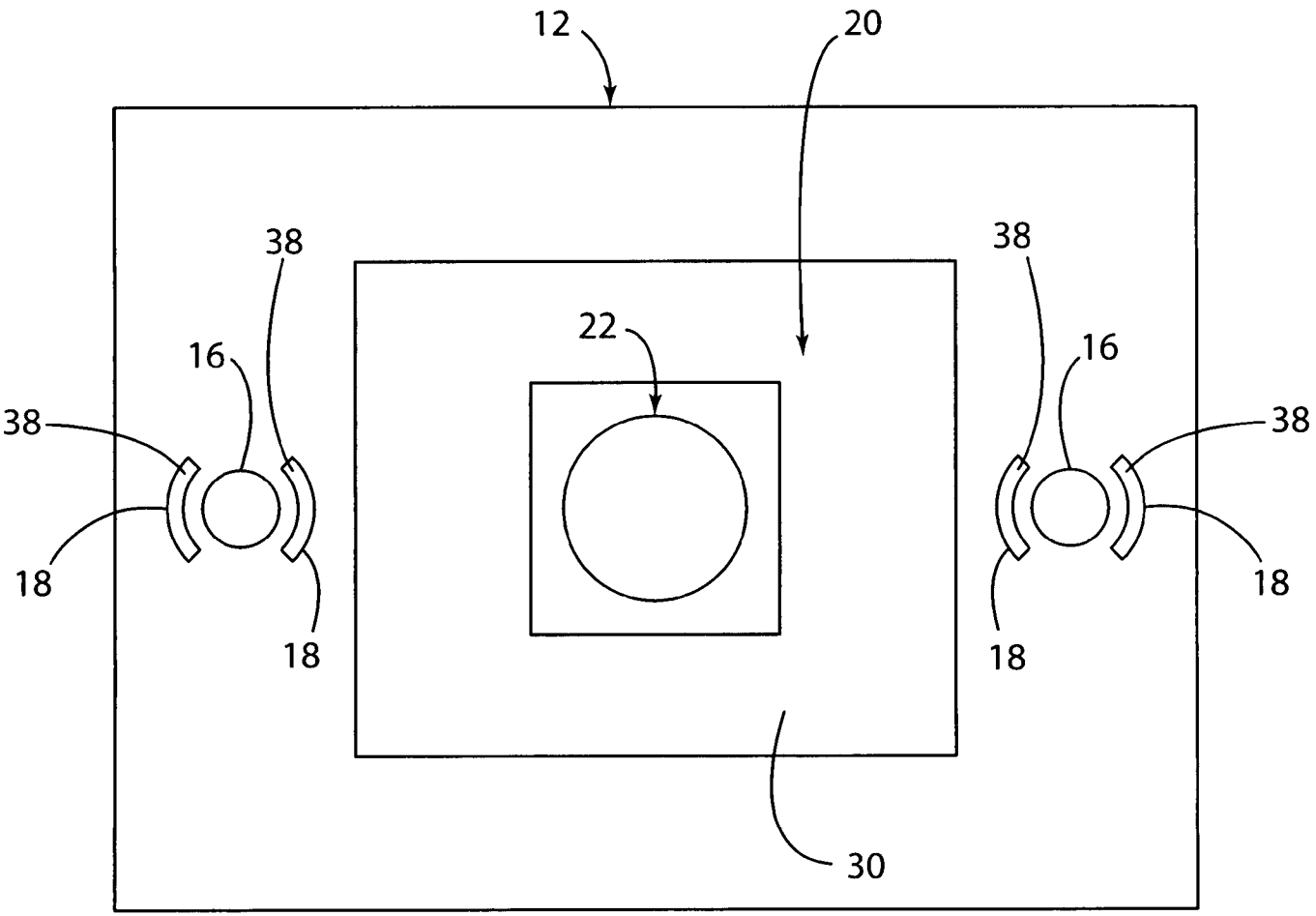
FIG. 3 is a bottom schematic view of a switch pad of the control assembly of the present invention.
Figure 4:
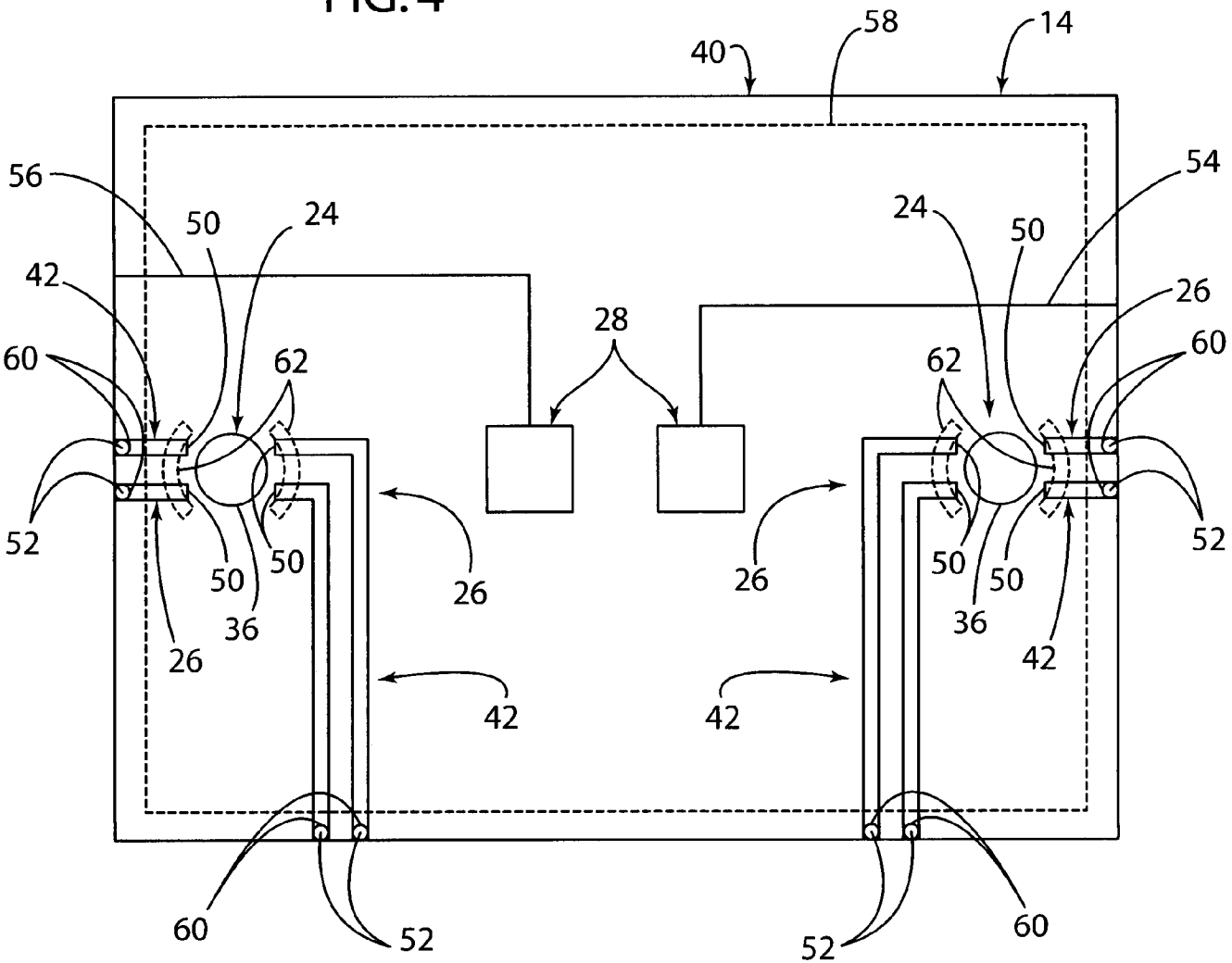
FIG. 4 is a top schematic view of a circuit board of the control assembly of the present invention.

The reference number 10 (FIG. 2) generally designates a control assembly embodying the present invention. In the illustrated example, the control assembly 10 comprises a switch pad 12 (FIG. 3) and a circuit board 14 (FIG. 4). The switch pad 12 has at least one connection member 16 and at least one first contact 18 adjacent at least one at least one connection member 16. The switch pad 12 further includes a flexible dome 20 having a second contact 22. The circuit board 14 is engaged with the switch pad 12 and includes at least one engagement area 24. Each engagement area 24 is engaged with at least one connection member 16. The circuit board 14 includes a set of third contacts 26 adjacent the engagement area 24 and a set of fourth contacts 28. The flexible dome 20 of the switch pad 12 is configured to be depressed to engage the second contact 22 with the set of fourth contacts 28 to electrically connect the set of fourth contacts 28. The at least one first contact 18 electrically connects the set of third contacts 26 when the switch pad 12 is properly engaged with the circuit board 14. The at least one first contact 18 and the set of third contacts 26 form a first circuit for determining if the switch pad 12 is properly engaged with the circuit board 14 such that the second contact 22 will form a second circuit with the set of fourth contacts 28 when the flexible dome 20 is depressed.

In the illustrated example, the switch pad 12 includes the flexible dome 20 with the second contact 22. The switch pad 12 is preferably made of a flexible material, and preferably from an elastomeric material. For example, the switch pad 12 can be made of rubber. Accordingly, the flexible dome 20 can be depressed to allow the second contact 22 of the flexible dome 20 to contact the set of fourth contacts 28 of the circuit board 14. It is contemplated, however, that only the flexible dome 20 could be made of the flexible material, with the remainder of the switch pad not being flexible. Furthermore, the second contact 22 could comprise any conductive material. For example, the second contact 22 could be formed integrally with the flexible dome 20, with the flexible dome 20 or a portion thereof being made of a conductive material, such as conductive rubber. Alternatively, the second contact 22 could comprise a conductive element connected to the flexible dome 20. For example, the second contact 22 could comprise a carbon disc or pill. Walls 30 of the flexible dome 20 are configured to collapse to allow the second contact 22 to contact the set of fourth contacts 28 of the circuit board 14 to form the second circuit. The switch pad 12 also includes an area 32 extending from the walls 30 of the flexible dome 20, with the area 32 preferably surrounding the walls 30. The area 32 includes the at least one connection member 16 for connecting the switch pad 12 to the circuit board 14.

The illustrated area 32 of the switch pad 12 surrounding the walls 30 of the flexible dome 20 includes the at least one connection member 16. In the illustrated example, the switch pad 12 includes two connection members 16. However, it is contemplated that any number of connection members 16 could be employed. The illustrated connection members 16 comprise push-though prongs 34 configured to connect the switch pad 12 to the circuit board 14 by extending the prongs 34 though openings 36 in the circuit board 14. The prongs 34 are flexible and compress while being pushed through the openings 36 in the circuit board 14. After the prongs 34 are inserted fully through the openings 36, the prongs 34 expand to engage the area of the circuit board 14 around the openings 36 and thereby connect the switch pad 12 to the circuit board 14. However, it is contemplated that the connection members 16 could comprise any member for connecting the switch pad 12 to the circuit board 14. For example, the connection members 16 could fit into the openings 36 with an interference fit, could comprise pull-though members or a combination of any of the above. Furthermore, it is contemplated that the connection member 16 could comprise any means of connecting the switch pad 12 to the circuit board 14.

In the illustrated example, the switch pad 12 includes the at least one first contact 18 adjacent at least one at least one connection member 16. The illustrated at least one first contact 18 is a pair of semi-circular contacts 38 surrounding each connection member 16. The semi-circular contacts 38 can be screened with conductive ink, a conductive pill or any conductive element. Furthermore, it is contemplated that a portion of the switch pad 12 itself could be conductive to form the first contact 18. Preferably, two semi-circular contacts 38 are adjacent each connection member 16. However, it is contemplated that any number of first contacts 18 could be adjacent only one connection member 16, a plurality of the connection members 16 (if the switch pad 12 has more than one connection member 16) or all of the connection members 16. Furthermore, while the first contacts 18 are illustrated as being semi-circular, it is contemplated that the first contacts 18 could have any geometrical configuration. The first contacts 18 are configured to engage the set of third contacts 26 to form the first circuit for determining if the switch pad 12 is properly engaged with the circuit board 14 such that the second contact 22 will form the second circuit with the set of fourth contacts 28 when the flexible dome 20 is depressed.

The illustrated circuit board 14 comprises a panel 40 having the set of third contacts 26 and the set of fourth contacts 28. Preferably, the set of fourth contacts 28 comprise two fourth contacts 28. The set of fourth contacts 28 are located under the dome 20 of the switch panel 12 such that depression of the dome 20 will force engagement of the second contact 22 with both the fourth contacts 28 to form the second circuit comprising a first lead 54 connected to a first one of the set of fourth contacts 28, the second contact 22, a second one of the set of fourth contacts 28, and a second lead 56 connected to the second one of the fourth contacts 28.

In the illustrated example, the illustrated panel 40 includes at least one engagement area 24 for connecting the switch pad 12 to the circuit board. Preferably, each engagement area 24 includes at least one opening 36. Furthermore, the circuit board 14 preferably includes one opening 36 for each connection member 16 of the switch pad 12. The openings 36 are configured to accept the connection member 16 of the switch pad 12 therein for connecting the switch pad 12 to the circuit board 14. However, it is contemplated that the engagement areas 24 could comprise any opening or member that allows the connection members 16 of the switch pad 12 to connect the switch pad 12 to the circuit board 14.

The illustrated circuit board 14 includes the set of third contacts 26 comprising a pair of spaced conductive tracks 42 ending adjacent the engagement areas 24 of the panel 40 of the circuit board 14. In the illustrated example, each pair of spaced conductive tracks 42 include a first end 50 adjacent the engagement area 24 and a second end 52 that extends beyond a perimeter area 58 of the switch pad 12 when the switch pad 12 is connected to the circuit board 14. In the illustrated example, at least one first contact 18 is configured to engage the first ends 50 of the pair of spaced conductive tracks 42 when the switch pad 12 is properly connected to the circuit board 14 to form the first circuit. Furthermore, each second end 52 of the pair of spaced conductive tracks 42 preferably includes a pin or test point 60. While the pin or test points 60 are illustrated as being located outside of the perimeter area 58, it is contemplated that the pin or test points 60 could be located within the perimeter area 58 and extend through the switch pad 12 or conductive tracks could extend through the circuit board 14, with the second ends 52 of the conductive tracks being located on an underside of the circuit board 14.

In use, the control assembly 10 is constructed by first connecting the switch pad 12 and the circuit board 14 by engaging the connection members 16 of the switch pad 12 with the engagement areas 24 of the circuit board 14. In the illustrated embodiment, the connection members 16 of the switch pad 12 are engaged with the engagement areas 24 of the circuit board 14 by inserting the push-though prongs 34 of the switch pad 12 through the openings 36 in the circuit board 14. If the switch pad 12 is properly engaged with the circuit board 14, each first contact 18 will abut the first end 50 of the pair of spaced conductive tracks 42 of the set of third contacts 26. FIG. 4 illustrates an interface area 62 where the first contacts 18 will overlay the third contacts 26. If the switch pad 12 is properly connected to the circuit board 14, a plurality of first circuits will be formed, with each first circuit comprising a first one of the conductive tracks 42 of one of the set of third contacts 26, one of the first contacts 18 and a second one of the conductive tracks 42 of the one of the set of third contacts 26. The first circuit can be checked to determine if the first circuit is closed by sending current through the pins or test points 60 at the second ends 52 of the pair of conductive tracks 42 of the one of the set of third contacts 26. If the current can go through the first circuit, the first circuit is closed. Furthermore, the remaining first circuits (if more than one first circuit exists) can also be tested. If any of the first circuits are open, the tester will know that the switch pad 12 is not properly connected to the circuit board 14 because the connection members 16 of the switch pad 12 are fully engaged with the engagement areas 24 of the circuit board 14, thereby spacing the first contacts 18 from the third contacts 26. Therefore, the switch pad 12 can be readjusted or replaced to form a working control assembly 10.

The reference numeral 10*a* (FIG. 5) generally designates another embodiment of the present invention, having a second embodiment for the control assembly. Since control assembly 10*a* is similar to the previously described control assembly 10, similar parts appearing in FIGS. 2–4 and FIG. 5, respectively, are represented by the same, corresponding reference number, except for the suffix "a" in the numerals of the latter. The second embodiment of the control assembly 10*a* is identical to the first embodiment of the control assembly 10, except that the second embodiment of the control assembly 10*a* includes a switch pad 12*a* having a plurality of domes 20*a*, with each dome 20*a* including a second contact 22*a*. Furthermore, the circuit board 14*a* includes a set of fourth contacts 28*a* for each dome 20*a* and each second contact 22*a*. Accordingly, it is contemplated that the switch pad 12*a* could include any number of domes 20*a*. Furthermore, it is contemplated that the switch pad 12*a* could include only one dome 20*a*, but with the dome 20*a* including a plurality of second contacts 22*a* and the circuit board 14*a* having a complementary number of sets of fourth contacts 28*a* for each second contact 22*a*. In this contemplated embodiment, the dome 20*a* includes a plurality of areas that can be depressed whereby depression of one of the areas will force engagement of only one (or not all) of the second contacts 22*a* with one of the sets of fourth contacts 28*a*.

Figure 6:
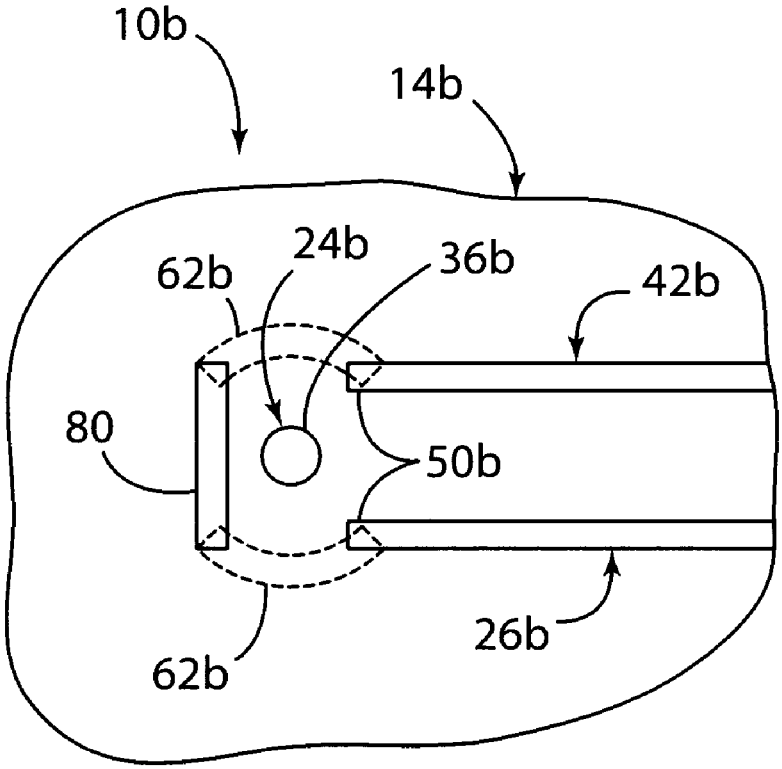
FIG. 6 is a top schematic view of a portion of a third embodiment of the control assembly of the present invention.

The reference numeral 10*b* (FIG. 6) generally designates another embodiment of the present invention, having a third embodiment for the control assembly. Since control assembly 10*b* is similar to the previously described control assembly 10, similar parts appearing in FIGS. 2–4 and FIG. 6, respectively, are represented by the same, corresponding reference number, except for the suffix "b" in the numerals of the latter. The third embodiment of the control assembly 10*b* is identical to the first embodiment of the control assembly 10, except that the third embodiment of the control assembly 10*b* includes a circuit board 14*b* having a different configuration for the set of third contacts 26*b*. The set of third contacts 26*b* for the third embodiment of the control assembly 10*b* includes the pair of spaced conductive tracks 42*b* and an auxiliary conductive track 80 on an opposite side of the engagement area 24*b* than the first ends 50*b* of the pair of spaced conductive tracks 42*b*. The auxiliary conductive track 80 can be formed in the same manner as the pair of spaced conductive tracks 42*b* as discussed above.

Figure 5:
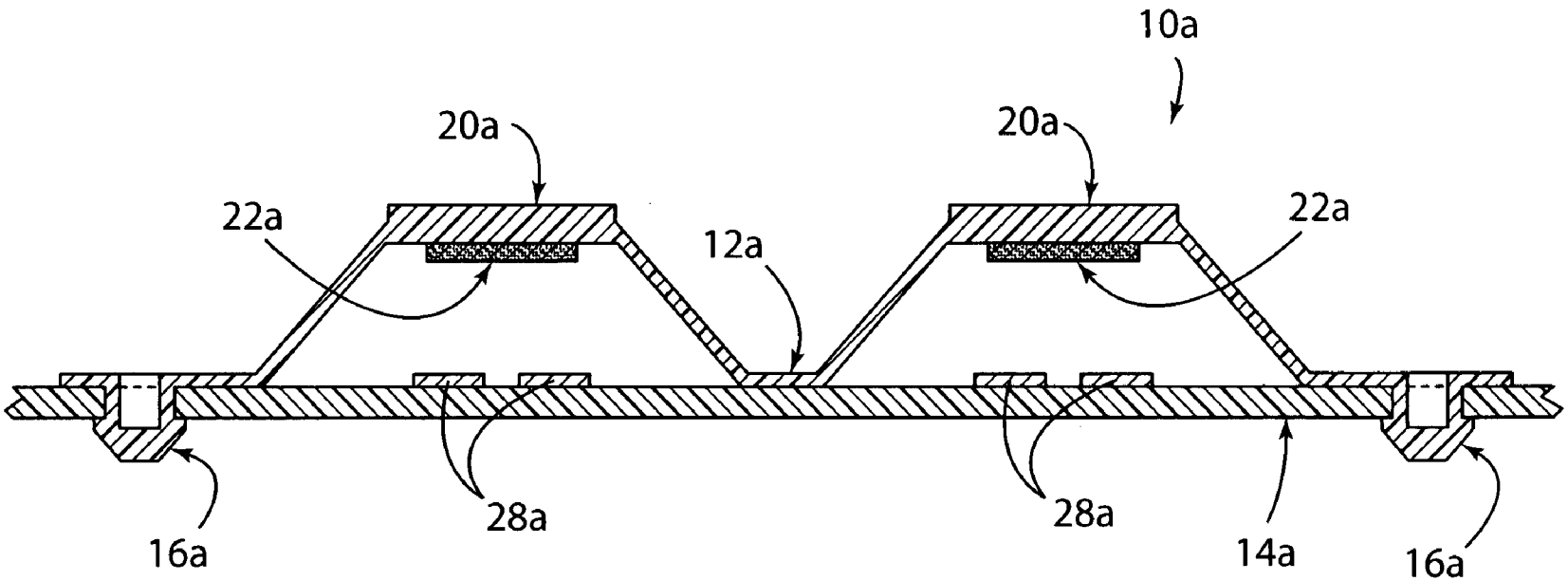
FIG. 5 is a cross-sectional schematic view of a second embodiment of the control assembly of the present invention.

In the third embodiment of the control assembly 10*b*, the first circuit is formed when the switch pad is properly connected to the circuit board 14*b*. FIG. 5 illustrates an interface area 62*b* where the first contacts will overlay the third contacts 26*b*. If the switch pad is properly connected to the circuit board 14*b*, a plurality of first circuits will be formed, with each first circuit comprising a first one of the conductive tracks 42*b* of the set of third contacts 26*b*, a first one of the first contacts, the auxiliary conductive track 80, a second one of the first contacts and a second one of the conductive tracks 42*b* of the one of the set of third contacts 26*b*. Once again, the first circuit can be checked to determine if the first circuit is closed using the pins or test points at the second ends of the pair of conductive tracks 42*b*. Furthermore, the remaining first circuits (if more than one first circuit is possible) can also be tested. If any of the first circuits are open, the tester will know that the switch pad is not properly connected to the circuit board 14*b* because the connection members of the switch pad will not be fully engaged with the engagement areas 24*b* of the circuit board 14*b*, thereby spacing the first contacts from the third contacts 26*b*. Therefore, the switch pad can be readjusted or replaced to form a working control assembly 10*b*.

It will be understood by those who practice the invention and those skilled in the art, that various modifications and improvements may be made to the invention without departing from the spirit of the disclosed concept. The scope of protection afforded is to be determined by the claims and by the breadth of interpretation allowed by law.

The invention claimed is:

1. A control assembly comprising:

a switch pad having at least one connection member and at least one first contact adjacent the at least one connection member, the switch pad further including a flexible dome having a second contact; and a circuit board engaged with the switch pad, the circuit board having at least one engagement area, with the at least one engagement area engaged with the at least one connection member, the circuit board further including a set of third contacts adjacent the at least one engagement area and a set of fourth contacts;

the flexible dome of the switch pad being configured to be depressed to engage the second contact with the set of fourth contacts to electrically connect the set of fourth contacts; and the at least one first contact electrically connecting the set of third contacts when the circuit board is properly engaged with the switch pad;

wherein the at least one first contact and the set of third contacts form a first circuit for determining if the switch pad is properly engaged with the circuit board such that the second contact will form a second circuit with the set of fourth contacts when the flexible dome is depressed.

2. The control assembly of claim 1, wherein:

the at least one connection member comprises a plurality of push-through prongs;

the at least one engagement area comprises a plurality of openings; and the switch pad is engaged with the circuit board by inserting each of the push-through prongs of the switch pad through one of the openings in the circuit board.

3. The control assembly of claim 1, wherein:

the set of third contacts comprises a pair of conductive tracks.

4. The control assembly of claim 3, wherein:

the pair of conductive tracks each include a first end adjacent the engagement area and a second end extending outside of an area of the circuit board covered by the switch pad.

5. The control assembly of claim 1, wherein:

the at least one first contact comprises a pair of first contacts for the at least one connection member, the pair of first contacts being positioned on opposite sides of the at least one connection member.

6. The control assembly of claim 5, wherein:

the set of third contacts comprises a pair of conductive tracks for the at least one first contact, with the pair of conductive tracks engaging the at least one first contact.

7. The control assembly of claim 1, wherein:

the at least one connection member comprises a plurality of connection members;

the at least one engagement area comprises a plurality of engagement areas, with each of the engagement areas engaging one of the connection members;

the at least one first contact comprises a pair of first contacts; and the set of third contacts comprises two pairs of third contacts, with each of the pairs of third contacts engaging one of the first contacts.

8. A method of determining if a switch pad of a control assembly is properly aligned with a circuit board of a control assembly, the method comprising:

providing the switch pad with at least one connection member, at least one first contact adjacent the at least one connection member and a flexible dome having a second contact;

providing the circuit board with an engagement area and a set of third contacts adjacent the engagement area and a set of fourth contacts;

engaging the switch pad with the circuit board by engaging the at least one connection member with the engagement area of the circuit board;

electrically connecting the at least one first contact and the set of third contacts; and sending a current through the set of third contacts to determine if the at least one first contact and the set of third contacts form a circuit.

9. The method of claim 8, wherein:

the at least one connection member comprises a plurality of push-through prongs;

the engagement area comprises a plurality of openings; and engaging the switch pad with the circuit board comprises inserting each of the push-through prongs of the switch pad through one of the openings in the circuit board.

10. The method of claim 8, wherein:

the set of third contacts comprises a pair of conductive tracks.

11. The method of claim 10, wherein:

the pair of conductive tracks each include a first end adjacent the engagement area and a second end extending outside of an area of the circuit board covered by the switch pad.

12. The method of claim 8, wherein:

the at least one first contact comprises a pair of first contacts for the at least one connection member, the pair of first contacts being positioned on opposite sides of the at least one connection member.

13. The method of claim 12, wherein:

the set of third contacts comprises a pair of conductive tracks for each of the pairs of first contacts, with each pair of conductive tracks engaging one of the pair of first contacts.

14. The method of claim 8, wherein:

the at least one connection member comprises a plurality of connection members;

the at least one engagement area comprises a plurality of engagement areas, with each of the engagement areas engaging one of the connection members;

the at least one first contact comprises a pair of first contacts; and the set of third contacts comprises two pairs of third contacts, with each pair of third contacts engaging one of the first contacts.

15. A control assembly comprising:

a switch pad having a connection member and at least one first contact at least partially surrounding the connection member, the switch pad further including a flexible dome having a second contact; and a circuit board having an opening, with the connection member of the switch pad extending through the opening to connect the switch pad to the circuit board, the circuit board including a set of third contacts adjacent the opening and a set of fourth contacts aligned with the second contact of the flexible dome of the switch pad;

the flexible dome of the switch pad being configured to be depressed to engage the second contact with the set of fourth contacts to electrically connect the set of fourth contacts; and the at least one first contact electrically connecting the set of third contacts when the switch pad is properly connected to the circuit board;

wherein the at least one first contact and the set of third contacts form a first circuit for determining if the switch pad is properly connected to the circuit board such that the second contact will form a second circuit with the set of fourth contacts when the flexible dome is depressed.

16. The control assembly of claim 15, wherein:

the connection member comprises a push-though prong; and the switch pad is engaged with the circuit board by inserting the push-through prong of the switch pad through the opening in the circuit board.

17. The control assembly of claim 15, wherein:

the set of third contacts comprises a pair of conductive tracks.

18. The control assembly of claim 17, wherein:

the pair of conductive tracks each include a first end adjacent the opening and a second end extending outside of an area of the circuit board covered by the switch pad.

19. The control assembly of claim 17, wherein:

the at least one first contact comprises a pair of first contacts positioned on opposite sides of the connection member.

20. The control assembly of claim 19, wherein:

the set of third contacts comprises a pair of conductive tracks for each of the pair of first contacts, with each pair of conductive tracks engaging one of the pair of first contacts.

* * * * *